United States Patent [19]

Marshall

[11] Patent Number: 4,473,084

[45] Date of Patent: Sep. 25, 1984

[54] ASHTRAY SNUFFER

[76] Inventor: George L. Marshall, 2056 S. U.S. Hwy. 19, Clearwater, Fla. 33516

[21] Appl. No.: 419,760

[22] Filed: Sep. 20, 1982

[51] Int. Cl.[3] ..... A24F 19/00; A24F 19/14

[52] U.S. Cl. ..... 131/235 R; 131/238; 131/256; 131/240 R

[58] Field of Search ..... 131/235 R, 238, 256, 131/240 R

[56] References Cited

U.S. PATENT DOCUMENTS

| | | | |
|---|---|---|---|
| 2,495,496 | 1/1950 | Agee | 131/235 R |
| 2,936,765 | 5/1960 | Talkington | 131/235 R |
| 3,477,444 | 11/1969 | Adams et al. | 131/235 R |
| 3,695,277 | 10/1972 | Moffa | 131/235 R |
| 3,840,027 | 10/1974 | Patterson | 131/240 |
| 4,055,193 | 10/1977 | Lehman | 131/235 R |
| 4,331,164 | 5/1982 | Bodenmann | 131/235 R |

*Primary Examiner*—V. Millin

*Attorney, Agent, or Firm*—Oltman and Flynn

[57] ABSTRACT

An ashtray snuffer having a main body and a top cover, wherein the main body serves as an ashtray and the top cover, which partially covers said main body loosely fits on top thereof. They could be sonic welded together in some cases. The top cover has a straight or downward sloping tapered hole that serves to extinguish a lighted cigarette by inserting it thereinto with a slight pressure which removes air and oxygen from the burning material without mutilating the cigarette. A holder or storage space for a cigarette lighter is also formed into the top cover. In another embodiment of the invention it may also have a storage space for new, unused cigarettes and a hinged cover for the inlet opening to the inside of the ashtray to prevent smoke from smoldering embers therein, to escape to the outside.

8 Claims, 6 Drawing Figures

FIG. 1
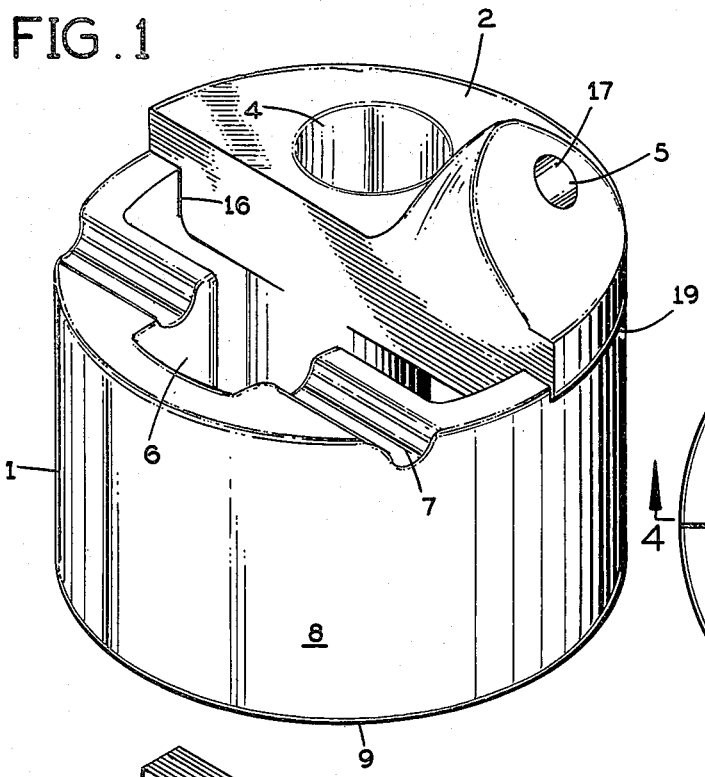
FIG. 2
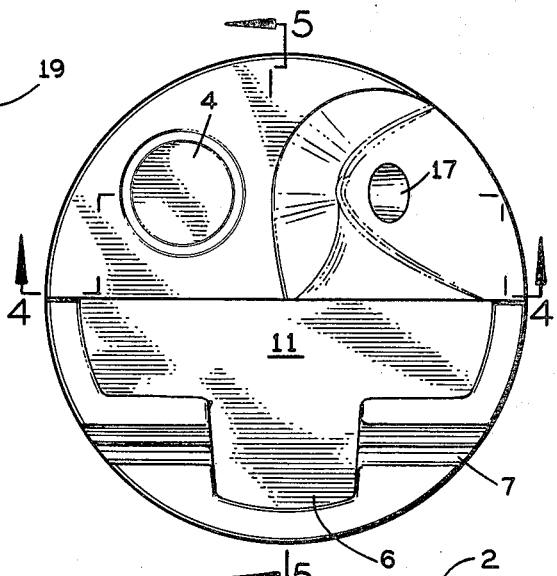
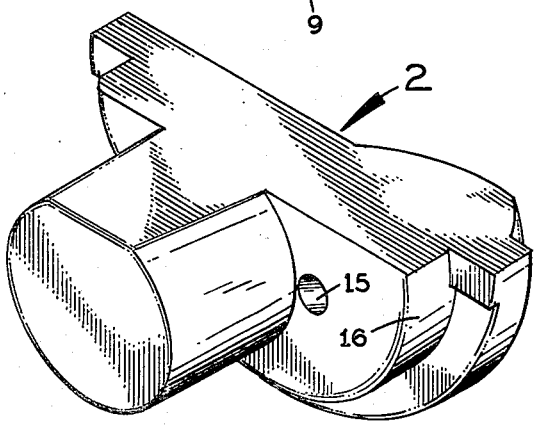
FIG. 3
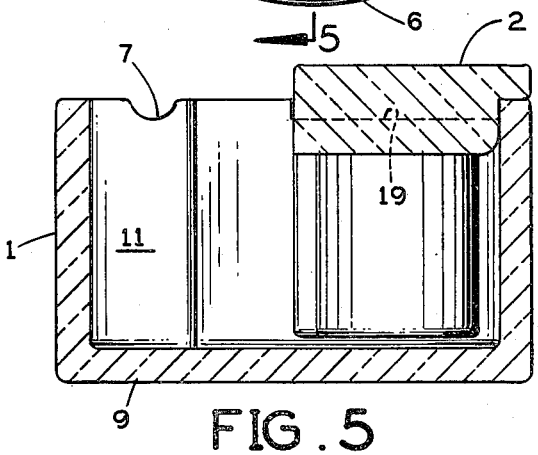
FIG. 5
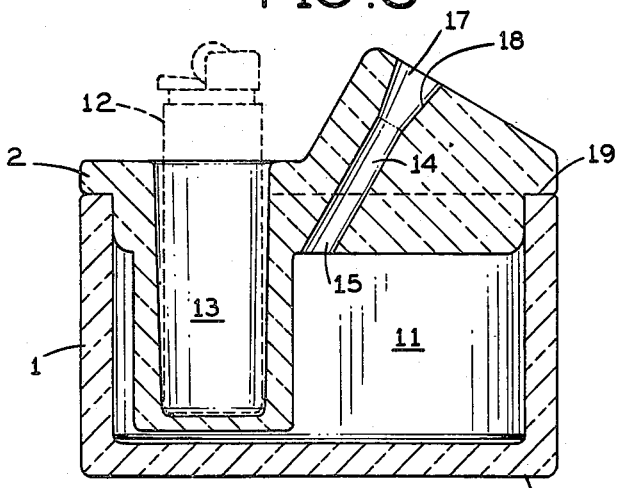
FIG. 4
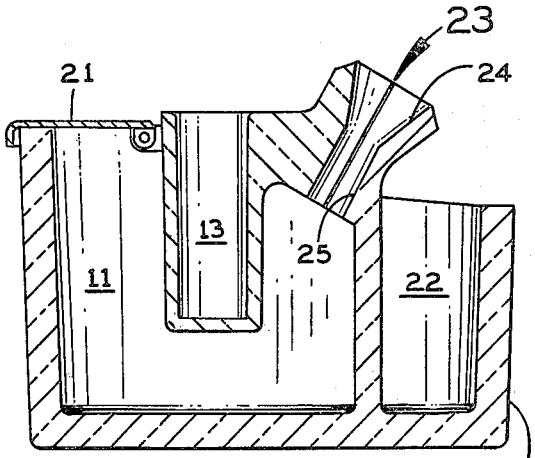
FIG. 6

ASHTRAY SNUFFER

BACKGROUND OF THE INVENTION AND PRIOR ART

For individuals who enjoy smoking cigarettes and small cigars also known as cigarillos, it is often difficult to dispose of such objects quickly and without leaving untidy, burning or smelly butts within sight, if smoking for some reason must be interrupted. People have for a long time been using ashtrays and other receptacles in which to "stub" a cigarette butt. Ashtrays with hinged covers have been used to seal off the interior of such an ashtray in order to prevent the smoke from the still smoking butt to enter the outside air. Often times a smoldering cigarette butt ignites other already spent butts contained in the ashtray and starts a small fire therein.

Other inventors have sought to devise ashtrays with means for snuffing butts.

U.S. Pat. No. 3,840,027 by R. Patterson issued Oct. 8, 1974 entitled Combination Cigarette Extinguisher and Ashtray, discloses a combination cigarette extinguisher and ashtray with a receiver for butts which is rotatable and removable. U.S. Pat. No. 2,495,496 by C. Agee, issued Jan. 24, 1950, entitled Ashtray with Snuffer discloses snuffers where levers operating in slots in the receivers for the butts serve to dislodge the butts and to drop them into the ashtray. U.S. Pat. No. 4,055,193 by J. Lehman, issued Oct. 25, 1977 and entitled Cigarette Snuffing Attachment for Ashtray discloses a cigarette snuffing apparatus with clamping arrangement for attachment to an existing ashtray. U.S. Pat. No. 3,695,277 by D. Moffa, issued Oct. 3, 1972 and entitled Cigarette Extinguisher discloses a rotatable carrier for cigarette butts containing extinguishing chambers for disposal of a lighted cigarette.

For individuals who enjoy smoking cigarettes and the like it is often times desirable to be able to quickly extinguish a cigarette without mutilating it and then again, perhaps a short time later, retrieve the partly smoked cigarette and relight it for continued smoking pleasure.

It is therefore the major object of the present invention to provide apparatus that affords the combined conveniences of quickly disposing a lighted cigarette or the like without mutilating it, and, combined therewith, or stored therewith, means for relighting the cigarette.

It is another object of the present invention to provide apparatus for disposing of a lighted cigarette without mutilating it combined with means for retrieving and relighting the partly smoked cigarette and such that said apparatus is suitable for mass production and is of aesthetically pleasing appearance and that may be conveniently installed in places where a smoking person may make use thereof.

Other objects of the invention will become clear in the course of the following description.

BRIEF DESCRIPTION OF THE DRAWINGS

FIG. 1 is a perspective view of the invention showing the inlet opening of the cigarette receiver, a space for storage of a cigarette lighter and the top cover of the ashtray;

FIG. 2 is a top-down view of the invention;

FIG. 3 is a perspective view of the separate top cover of the ashtray;

FIG. 4 is a vertical cross-sectional view of the invention seen along the line 4—4 of FIG. 2, showing the interior of the cigarette receiver, the interior of the storage space for the lighter and the interior of the ash receptacle;

FIG. 5 is a vertical cross-sectional view of the invention seen along the line 5—5 of FIG. 2; showing the interior of the ash receptacle; and FIG. 6 is a cross-sectional of an embodiment having a storage space for new cigarettes and a hinged cover.

DETAILED DESCRIPTION

The following section describes in detail and in relation to the drawings some of the preferred embodiments of the invention. It should be understood however that the invention is capable of other embodiments which may be obvious to those skilled in the art.

The terminology used is for description and not for limitation.

Referring now mostly to FIGS. 1 and 2, the invention consists of a main body 1 which is a generally cylindrical body consisting of a cylindrical vertical wall 8 and a generally circular bottom plate 9 and a loosely fitting top cover 2. The wall 8, bottom plate 9 and top cover 2 define an inner cavity 11 with an entrance opening 6. The inner cavity 11 serves as a receptacle for cigarette ashes, that may be dropped through the entrance opening 6 or may be dropping from the receiver 5 for cigarettes that have been inserted into the receiver to be extinguished.

Two generally horizontal grooves 7 are formed in the upper part of the main body 1 and serve as temporary repositories for lighted cigarettes, that may be placed in said repositories with their lighted ends over the inner cavity 11, so that ashes and embers therefrom may drop into said cavity.

The top cover 2 is a generally horizontal, part circular planar plate having an outer perimeter that conforms generally to the outer perimeter of aforesaid vertical cylindrical wall 8.

The top cover only partially covers the top of said cylindrical wall 8 in order to provide an entrance opening 6 to said inner cavity 11. The top cover has on its underside an indentation 16 which has a part circular perimeter that generally conforms to the inside perimeter of the vertical cylindrical wall 8 except for the entrance opening 6 to the inner cavity 11, which it leaves accessible. The top cover in this way fits loosely on top of said main body of the ashtray, with said indentation fitting inside said cylindrical wall 8.

The top cover has a receiver 5 for cigarettes that are to be extinguished. The receiver 5 consisting of a downward sloping generally tubular opening with a circular inlet opening 17 leading into a downward tapered section 18 which continues into a cylindrical section 14 that is disposed coaxially with aforesaid tapered section 18. Aforesaid inlet opening 17 is slightly larger in diameter than the diameter of an ordinary cigarette and tapers to a diameter that is somewhat less than the diameter of such a cigarette, which, it follows, is the same as the diameter of aforesaid cylindrical section 14.

A generally vertical, at the top open-ended storage space 13 for a cigarette lighter 12, shown in phantom lines is also provided in the top cover 2.

A part 19 of the top rim of the cylindrical wall 8 has optionally been recessed downward a short distance so as to provide a "cradling" recess for the top cover 2.

In other variations of the invention, the tapered receiver 5 for a cigarette may be molded into the main body 2 instead of the top cover. In still another embodiment the receiver 5 may be molded with its axis disposed in the dividing line between the top cover and the upper rim of the main body 1. With this arrangement, when the top cover 2 is removed, the entire inside of the receiver 5 is laid open for cleaning. A receiver of this construction is shown in FIG. 6.

In operation, when a person smoking a cigarette or the like suddenly encounters a situation in which he wishes to extinguish the cigarette, he simply inserts the lighted cigarette into the receiver 5. The burning end of the cigarette, as it is inserted with a slight pressure into the receiver has its burning end compressed in the tapered section 18 of the receiver. Air and oxygen is thereby removed from the burning part which is quickly extinguished without emitting smoke, that may be annoying to non-smokers standing nearby. At the same time, ashes and unburned particles from the cigarette drop down through the cylindrical section 14 and the bottom opening 15 of the receiver, into the receptacle inside the main body of the ashtray. The cigarette is, in this way, extinguished cleanly and is not mutilated.

At a later time, as the smoker again wishes to resume smoking his cigarette, he simply retrieves his partly smoked cigarette from the receiver, and reaches for the lighter or matches, that are stored in the storage space 13 for a lighter or matches and proceeds to relight the cigarette.

OTHER EMBODIMENTS

In another embodiment of the invention, a hinged cover plate 21, shown on FIG. 6 is provided over the entrance opening to the inner cavity 11 so as to prevent smoke from a smoldering cigarette butt dropped into aforesaid cavity 11 from emitting annoying smoke from the ashtray.

In still another embodiment of the invention seen in FIG. 6, a generally vertical, upward open-ended storage space 22 for new cigarettes or the like is also provided in the top cover, or it may be made a part of the main body 1 of the ashtray. FIG. 6 shows an embodiment comprising in combination an ashtray according to the present invention which has a hinged cover plate 21, a storage space 22 for new cigarettes and a receiver for lighted cigarettes 23, with a tapered upper section 24 and a cylindrical lower section 25 and where said receiver is divided into an upper halfpart that is molded into the top cover 26 and a lower halfpart that is molded into the main body 26 of the ashtray.

The ashtray snuffer may be made of any suitable non-flammable material such as glass, ceramic, plastic, stone or the like. The ashtray could be used in an automobile.

I claim:

1. An ashtray snuffer for cigarettes and the like comprising:

a main body having generally vertical walls and a bottom plate;

a top cover, said vertical walls, bottom plate and top cover defining an inner cavity, said cavity serving as a receptacle for ashes, spent cigarettes and the like;

at least one receiver for lighted cigarettes, said receiver formed as a generally downward sloping hole, said hole having an upper, circular inlet opening, said inlet opening somewhat larger in diameter than the diameter of an ordinary cigarette, said inlet opening leading to an upper tubular, tapered snuffing section of said receiver for snuffing cigarettes, said tapered section narrowing down to a diameter that is somewhat less than the diameter of an ordinary cigarette, said tapered section extending downward into a lower tubular section of said receiver, said upper and lower tubular sections of said receiver disposed concentrically on the same axis, said lower tubular section leading into said inner cavity for depositing ash in said cavity;

a generally vertical, cylindrical upward open-ended storage space for cigarette lighting means.

2. An ashtray snuffer as defined in claim 1 further comprising at least one generally horizontal repository for at least one lighted cigarette, said repository so disposed that the lighted end of said cigarette is positioned generally vertically above said inner cavity.

3. An ashtray snuffer as defined in claim 1, wherein said receiver is formed as a generally downward sloping hole through said top cover.

4. An ashtray snuffer as defined in claim 1 wherein said top cover partially covers said inner cavity, thereby providing an inlet opening to said inner cavity, said inner cavity providing a receptacle for ashes and spent cigarettes.

5. An ashtray snuffer as defined in claim 4 further comprising a hinged cover for said inlet opening to said inner cavity.

6. An ashtray snuffer as defined in claim 1 further comprising a generally vertical, upward open-ended storage space for new cigarettes and the like.

7. An ashtray snuffer as defined in claim 1 wherein said cigarette receiver is divided into an upper and a lower part, said upper part formed into said top cover and said lower part formed into said main body.

8. An ashtray snuffer as defined in claim 1 wherein said main body, said bottom plate and said top cover are made from one piece of material.

* * * * *